United States Patent [19]

Magee

[11] Patent Number: 4,471,856

[45] Date of Patent: Sep. 18, 1984

[54] ELEVATOR DOOR INTERLOCK

[76] Inventor: John E. Magee, 85 Milford Point Rd., Milford, Conn. 06460

[21] Appl. No.: 407,725

[22] Filed: Aug. 13, 1982

[51] Int. Cl.[3] ..... B66B 13/22

[52] U.S. Cl. ..... 187/29 R; 187/48; 200/61.65

[58] Field of Search ..... 187/29, 31, 48–50; 200/61.65

[56] References Cited

U.S. PATENT DOCUMENTS 2,918,988 12/1959 Green ..... 187/31

3,075,617 1/1963 Etter ..... 187/50 X 3,277,979 10/1966 Stutz ..... 187/50

3,625,312 12/1971 Hutner ..... 187/48

*Primary Examiner*—G. Z. Rubinson

*Assistant Examiner*—W. E. Duncanson, Jr.

*Attorney, Agent, or Firm*—Brooks, Haidt, Haffner & Delahunty

[57] ABSTRACT

A door interlock switch is provided for an elevator. The switch means is mounted in a housing adjacent the door, the housing having an opening which permits the entrance of a permanent magnet actuating means. A barrier is mounted in the housing to prevent access to the switch by mechanical devices but which will permit the switch to be operated by the permanent magnet.

6 Claims, 3 Drawing Figures

ELEVATOR DOOR INTERLOCK

This invention relates to interlocks for doors and particularly, to doors in elevator systems.

In elevator systems, it is necessary that the hoistway doors be locked in their closed positions when there is no elevator car at the floors where the doors provive access to the car. It is customary to provide, at each floor, locking apparatus which locks the hoistway door when the car is ready to depart from the floor at which the hoistway door is located and which unlocks the hoistway door when the car arrives at the floor. It is also customary to provide, at each floor, switching apparatus at each floor which is operated when the hoistway door is closed to enable the car hoisting apparatus to move the car away from the floor and which interrupts the energization of the car hoisting apparatus when a hoistway door is open.

One known form of combined locking and switching apparatus is sold by G.A.L. Manufacturing Co., New York, N.Y., under the designation Type SM interlock. Such interlock comprises a housing mounted on the hoisting in a position in which it receives a keeper mounted on the hoistway door when the hoistway door is closed. A latch bolt in the housing is received in a window in the keeper and maintains the hoistway door locked when the elevator car is not at the floor where the hoistway door is located. However, by means of a cam carried by the car, the latch bolt is withdrawn from the window, permitting opening of the hoistway door when the elevator car arrives at the floor.

The housing also contains a pair of contacts which are electrically interconnected, thereby completing a control circuit for the car hoisting apparatus, when a conductive strip on the keeper engages the contacts. Therefore, when the hoistway door is closed, the control circuit is enabled and when the hoistway door is open, the control circuit prevents movement of the elevator car away from the floor.

The housing has an opening through which the keeper passes as the hoistway door is closed and opened. When the hoistway door is open, access to the contacts can be obtained through such opening. In many cases, persons cause unauthorized operation of an elevator car, for mischievous or criminal purposes by inserting metal coat hangers, knives or other metal objects through the opening, when the hoistway door is open, to electrically interconnect the contacts within the housing. When such contacts are so interconnected and a car button for another floor has been pressed, usually prior to unauthorized interconnection of the contacts, the car will move toward the other floor even if the hoistway door is not closed. Thus, without entering the car after the contacts are interconnected and without closing the hoistway door, the car can be caused to move toward and to another floor. Also, if the metal object which has been inserted to interconnect the contacts is removed after the car moves downwardly from the floor a short distance, the car will stop permitting unauthorized and unsafe access to the top of the car through the open hoistway doorway.

The principal object of the invention is to make it difficult for unauthorized persons to override the elevator door interlock.

A further object of the invention is to prevent completion of the interlock circuit by conductive objects inserted in the interlock switching apparatus.

In accordance with the preferred embodiment of the invention, the switch for completing the car control circuit is magnetically operable and is operated by a permanent magnet secured to the hoistway door when the door is closed. A barrier is mounted adjacent the switch which will prevent access to the switch by mechanical devices but which will permit the switch to be operated by the permanent magnet.

Other objects and advantages of the present invention will be apparent from the following detailed description of the presently preferred embodiments thereof, which description should be considered in conjunction with the accompanying drawings in which.

Although the invention will be described in connection with the prior art interlock identified hereinbefore and in connection with elevator systems, it will be apparent to those skilled in the art that the principles of the invention may be employed with other types of interlocks or with other systems.

Figure 1:
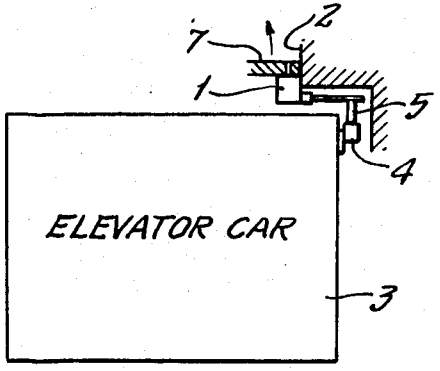
FIG. 1 is a schematic, plan view of an elevator car at a floor and the associated interlock apparatus of the invention.

FIG. 1 illustrates a G.A.L. Manufacturing Co. type SM interlock 1, modified as described hereinafter, mounted on the wall 2 of an elevator hoistway. An elevator car 3 is stopped at the floor where the interlock 1 is located and carries a cam 4 which operates an arm 5 to operate a latch bolt 6 (FIGS. 2 and 3) in the conventional manner to unlock the hoistway door 7 which, in the example illustrated is a swinging door. Of course, the invention may also be used with sliding hoistway doors with obvious changes in the position and mechanism of the interlock 1.

Figure 3:
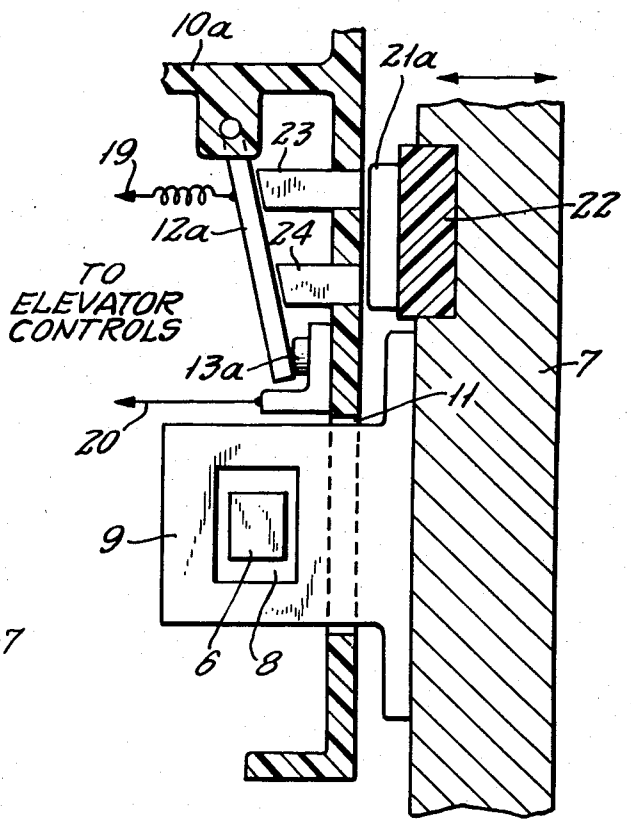
FIG. 3 is a fragmentary view, similar to FIG. 2, of a modified embodiment of the invention.
Figure 2:
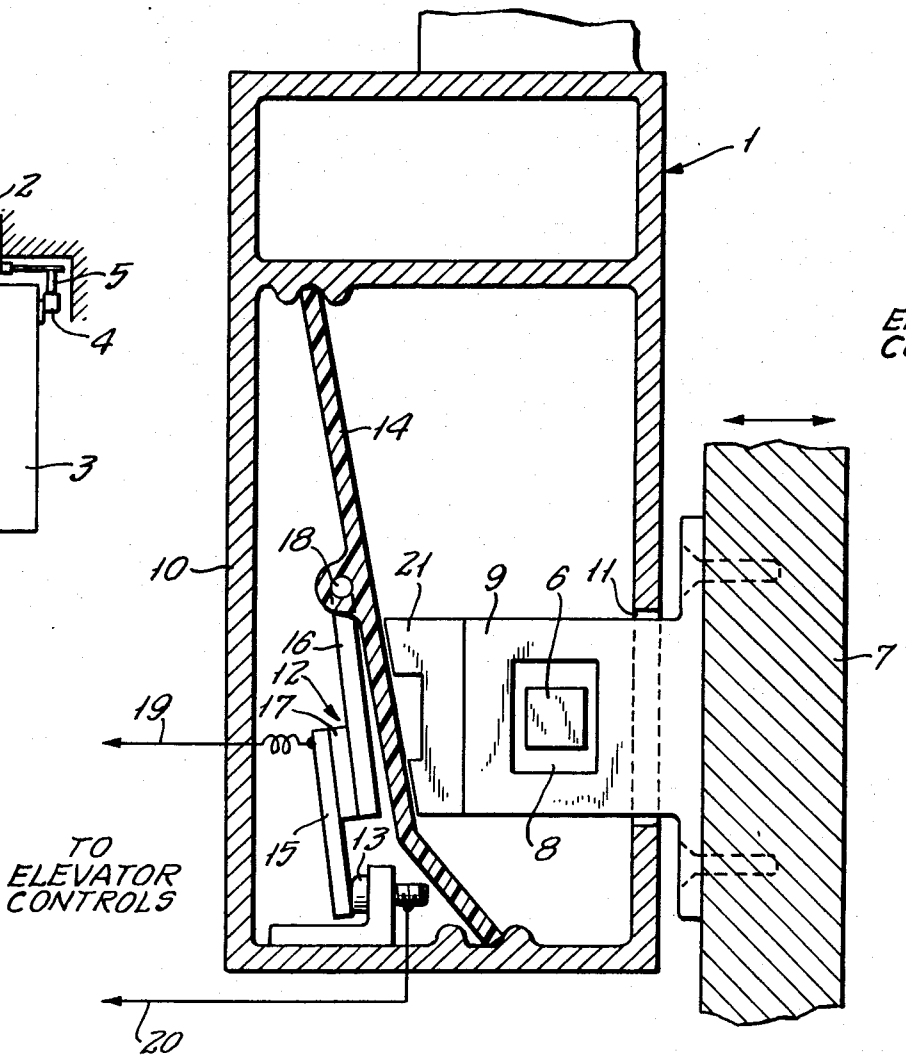
FIG. 2 is a side elevation view, partly in cross-section, of the interlock apparatus of the invention.

The mechanical portion of interlock 1 operates in the conventional manner and the details of such mechanical portion have been omitted from FIGS. 2 and 3. When the car 3 arrives at a floor, the cam 4 thereon causes the arm 5 to pivot, and through mechanical linkages, (not shown), the arm 5 causes the latch bolt 6, which normally extends through an opening or window 8 in a keeper 9 secured to the hoistway door 7, to withdraw from such opening 8, thereby permitting the door 7 to be opened. When the car 3 is away from the floor, the latch bolt 6 extends through the opening 8 which prevents opening of the door 7 when the car 3 is not at the floor.

In the prior art interlock, the operating mechanism for the latch bolt 6 as well as a pair of electrical contacts are mounted within a housing 10 (FIG. 2), usually made of metal. A conductive strip mounted on the free end of the keeper 9 engages such contacts when the door 7 is closed to complete a control circuit for the hoistway apparatus which permits the elevator car 3 to depart from the floor when the door 7 is closed.

It will be observed that the keeper 9 passes through an opening 11 in the housing 10 which is relatively narrow. However, with the door 7 open, a conductive object can be inserted through the opening 11 and into contact with the contacts thereby permitting the car 3 to move away from the floor if a call button or a car button from another floor has been pressed. When the object is removed, the car 3 will stop at the position it has reached when the object is removed.

It will be apparent that by the insertion of a conductive object through the opening 11 of the prior art interlock movement of the car 3 can be controlled, and for example, while holding the door 7, the car 3 can be caused to move to a position permitting access to the top of the car 3. Also, the car 3 can be moved to a position with the door 7 open such that one falling through the open hoistway doorway would be seriously injured. Thus, by relatively simple means, unsafe conditions can be created by malicious or mischievous persons.

In order to prevent such unauthorized operation of the car 3, and thereby reduce or eliminate such risks, the modified interlock 1 of the embodiment of the invention shown in FIG. 2 employs a magnetically operable switch comprising a pivotable arm 12 and a contact 13 and a barrier 14 of non-magnetic material, e.g., of plastics material. The arm 12 comprises a conductive member 15 secured to a magnetic member 16 by way of an insulating member 17. The barrier 14 is secured to the housing 10 in any suitable manner, and the member 16 is pivotally mounted on the barrier 14 at 18. The member 15 and the contact 13 are connected to the elevator controls by the leads 19 and 20 in the conventional manner.

The keeper 9 carries a permanently magnetized magnet 21 at its free end, the dimensions of the magnet 21 being such that it will pass through the opening 11 with clearance. The keeper 9 should be made of non-magnetic material or the magnet 21 should be spaced from the keeper 9 by non-magnetic material to prevent shunting of the magnetic field of the magnet 21.

FIG. 2 illustrates the hoistway door 7 in its closed position with the magnet 21 adjacent to the front face of the barrier 14. In such position of the magnet 21, the member 16, and hence, the member 15, are pulled toward the barrier 14 by the magnetic field of the magnet 21 until the member 15 contacts the contact 13 which completes a circuit of the elevator controls to permit the car 3 to depart from the floor.

When the door 7 is opened, the magnet 12 is withdrawn from the housing 10, and the member 15 separates from the contact 13 by gravity or by reason of a spring (not shown) acting thereon. The latch bolt 6 is operated by the car 3 in the conventional manner.

It will be apparent from the foregoing that the insertion of an object which is merely conductive into the housing 10 by way of the opening 11 will not cause electrical interconnection of the lines 19 and 20. Contact with the member 15 and the contact 13 is prevented by the barrier 14, and to operate the member 15, it is necessary to have a special tool having a permanent magnet 21 of the proper dimensions.

A modified embodiment of the invention is illustrated in FIG. 3. In this embodiment, it is not necessary to include the barrier 14, but the housing 10*a* must be made, at least in part, of non-magnetical material. In the embodiment shown in FIG. 3, the arm 12*a* of magnetic material is pivotally mounted from the housing 10*a* and is pulled toward the contact 13*a* by a permanent magnet 21*a* mounted on the door 7 rather than on the keeper 9. The housing 10*a* is made of a non-magnetic material, e.g., a plastics material, but if desired, only a portion of the housing 10*a*, intermediate the magnet 21*a* and the arm 12*a*, may be made of non-magnetic material.

If the door 7 is made of non-magnetic material, the magnet 21*a* may be merely attached thereto or inset therein. However, if the door 7 is made of magnetic material, the magnet 21*a* may be mounted on a slab 22 of non-magnetic material of a size which will prevent substantial shunting of the magnetic field of the magnet 21*a*.

If the magnet 21*a* has sufficient strength, the magnet pole extenders 23 and 24 of magnetic material mounted on the housing 10*a* may be omitted, but preferably, such pole extenders 23 and 24 are included to assure operation of the arm 12*a* when the door 7 is closed. The pole extender 23 extends from adjacent one pole of the magnet 21*a* to adjacent the arm 12*a*, and the pole extender 24 extends from adjacent the other pole of the magnet 21*a* to adjacent the arm 12*a*.

The operation of the embodiment illustrated in FIG. 3 is the same as the operation of the embodiment illustrated in FIG. 2. It will be observed that the insertion of an object, conductive or magnetized, through the opening 11 will not cause operation of the arm 12*a* and contact thereof with the contact 13*a*, the housing 10*a* itself acting as a barrier to access to the arm 12*a* and the contact 13*a*. Also, conductive interconnection of the pole extenders 23 and 24 will not cause interconnection of the arm 12*a* and the contact 13*a*. However, since a magnet of any size sufficient to span the pole extenders 23 and 24 and of sufficient magnetic field strength will operate the arm 12*a* when placed adjacent the pole extenders 23 and 24, the embodiment of FIG. 2 is preferred because of the increased difficulty in unauthorized operation of the arm 12, a magnet 21 of special dimensions mounted on a tool of adequate length being required with the embodiment shown in FIG. 2.

Although preferred embodiments of the present invention have been described and illustrated, it will be apparent to those skilled in the art that various modifications may be made without departing from the principles of the invention.

What is claimed is:

1. In an elevator system comprising a hoistway in which an elevator car moves between floors, at least one movable door providing access to said hoistway from a hallway at a floor, control means for controlling movement of said car, said control means including switch means responsive to the position of said door, the improvement in said switch means comprising:

a switch housing mounted adjacent said door and providing a switch chamber, said housing having an opening for permitting the entrance of switch actuating means into said chamber;

magnetically operable switch means mounted within said chamber at a position therein spaced from said opening, said switch means comprising contact means connected to said control means and a gravity and magnetic field operable member, said gravity and magnetic field operable member, in the absence of a magnetic field, being held by gravity out of contact with said contact means to prevent movement of said elevator car;

permanently magnetized means mounted on said door for movement therewith and mounted for movement by said door into a position in which it moves said gravity and magnetic field operable member into contact with said contact means when said door is closed;

a non-magnetic, switch protecting means mounted on said housing between said magnetically operable switch means and said door for preventing unauthorized access to said magnetically operable switch means through said opening but permitting movement of said gravity and magnetic field operable member by said permanently magnetized means into contact with said contact means and thereby, permitting movement of said elevator car.

2. Switch means as set forth in claim 1 wherein said permanently magnetized means is mounted on said door for movement by said door into said opening and to adjacent said gravity and magnetic field operable member and wherein said non-magnetic, switch protecting means is mounted in said chamber between said gravity and magnetic field operable member and said opening.

3. Switch means as set forth in claim 1 wherein said housing has a non-magnetic portion spaced from said opening and said gravity and magnetic field operable member is mounted adjacent said portion and wherein said permanently magnetized means is mounted for movement by said door into a position adjacent said portion.

4. Switch means as set forth in claim 2 wherein said permanently magnetized means is a permanent magnet and said gravity and magnetic field operable member is made of a magnetic material and is pivotally mounted in said chamber so that it moves away from said contact when said permanent magnet is spaced predetermined distance therefrom.

5. Switch means as set forth in claim 2 further comprising a latch operable in accordance with the position of said car and wherein said permanently magnetized means is mounted on said door by a keeper having an opening therein for receiving said latch, whereby said latch is received in said opening when the car is away from a floor.

6. Switch means as set forth in claim 3 wherein said permanently magnetized means is a permanent magnet and said gravity and magnetic field operable member is made of a magnetic material and further comprising spaced members of magnetic material mounted on said housing and extending respectively from adjacent one pole of said magnet to adjacent one portion of said gravity and magnetic field operable member and from adjacent the other pole of said magnet to adjacent another portion of said gravity and magnetic field operable member when said door is closed.

* * * * *